US007297050B2

(12) United States Patent
Bridenne et al.

(10) Patent No.: US 7,297,050 B2
(45) Date of Patent: Nov. 20, 2007

(54) METHOD AND DEVICE FOR DIFFUSING A PROTECTIVE FLUX WITH REGARD TO A SURROUNDING ENVIRONMENT

(75) Inventors: Pierre Bridenne, Forges-les-Bains (FR); Pascale Coffinier, Lardy Bourg (FR)

(73) Assignee: Acanthe, Lardy (FR)

( * ) Notice: Subject to any disclaimer, the term of this patent is extended or adjusted under 35 U.S.C. 154(b) by 0 days.

(21) Appl. No.: 10/477,704

(22) PCT Filed: May 14, 2002

(86) PCT No.: PCT/FR02/01627

§ 371 (c)(1),
(2), (4) Date: May 25, 2004

(87) PCT Pub. No.: WO02/093082

PCT Pub. Date: Nov. 21, 2002

(65) Prior Publication Data

US 2004/0198215 A1 Oct. 7, 2004

(30) Foreign Application Priority Data

May 14, 2001 (FR) ..... 01 06333

(51) Int. Cl.
*B01L 1/04* (2006.01)

(52) U.S. Cl. ..... 454/187; 454/190

(58) Field of Classification Search ..... 454/60, 454/187–190, 296, 293, 294
See application file for complete search history.

(56) References Cited

U.S. PATENT DOCUMENTS

| | | | | |
|---|---|---|---|---|
| 3,511,162 | A * | 5/1970 | Truhan | 454/187 |
| 3,726,204 | A * | 4/1973 | Lindestrom | 454/189 |
| 3,895,570 | A | 7/1975 | Eagleson et al. | |
| 4,009,647 | A * | 3/1977 | Howorth | 454/187 |
| 4,554,766 | A * | 11/1985 | Ziemer et al. | 52/28 |
| 4,854,224 | A * | 8/1989 | Hirayama | 454/187 |
| 4,864,459 | A | 9/1989 | Larigaldie et al. | |
| 5,232,401 | A * | 8/1993 | Fujita et al. | 454/187 |

(Continued)

FOREIGN PATENT DOCUMENTS

DE 37 11 613 10/1988

(Continued)

*Primary Examiner*—Gregory Wilson
(74) *Attorney, Agent, or Firm*—Young & Thompson

(57) ABSTRACT

Device and method for diffusing a protective flux. In order to protect one area of a service station, a more or less parallel air flow is created in the direction of the area. Above a threshold F, the air flow has a gradually increasing speed V22 and, below the threshold, the air flow speed V21 is more or less uniform along the length of a flow section in a plane P which is transverse to the direction of flow D. One possible configuration for an air flow diffusion device, which allows a confinement barrier to be created, consists of a diffusing wall comprising a main wall and a lateral wall. The main planar wall is adapted to diffuse a main laminar flow in the sterile area to be protected. The lateral wall is adapted to diffuse a lateral flow divergent from the main flow. A skirt is disposed to create an obstacle to the lateral flow and to accelerate the flow by of deflection.

53 Claims, 2 Drawing Sheets

U.S. PATENT DOCUMENTS

| | | | | | |
|---|---|---|---|---|---|
| 5,830,058 | A | * | 11/1998 | Rosjo | 454/187 |
| 6,080,060 | A | * | 6/2000 | Larsson | 454/187 |
| 6,113,486 | A | * | 9/2000 | Beudon et al. | 454/187 |
| 6,482,083 | B1 | * | 11/2002 | Nilsson | 454/187 |
| 6,702,662 | B2 | * | 3/2004 | Kristensson | 454/187 |
| 6,733,557 | B1 | | 5/2004 | Beudon et al. | |
| 6,817,941 | B1 | * | 11/2004 | Gatov | 454/187 |

FOREIGN PATENT DOCUMENTS

| | | |
|---|---|---|
| DE | 20 008 892 | 10/2000 |
| EP | 0 878 670 | 11/1998 |
| FR | 2 785 040 | 4/2000 |
| GB | 1 318 364 | 5/1973 |
| JP | 50-8468 | 3/1975 |
| JP | 60-50329 | 3/1985 |
| JP | 60-129539 | 7/1985 |
| JP | 60-144544 | 7/1985 |
| JP | 60-213753 | 10/1985 |
| JP | 61-27435 | 2/1986 |
| JP | 64-28928 | 2/1989 |
| JP | 5-25241 | 4/1993 |
| JP | 60-41749 | 3/1995 |
| JP | 10-286428 | 10/1998 |
| JP | 2001-4178 | 1/2001 |
| WO | WO 85/04240 | 9/1985 |
| WO | WO 00/32150 | 6/2000 |

* cited by examiner

METHOD AND DEVICE FOR DIFFUSING A PROTECTIVE FLUX WITH REGARD TO A SURROUNDING ENVIRONMENT

BACKGROUND OF THE INVENTION

The present invention relates to a method for diffusing a stream, for example of treated air, in order to protect a zone with regard to a risk of contamination, in particular airborne, present in a surrounding environment.

It also relates to a diffuser associated with the method, that is, a device for diffusing a hygienic stream in a zone to be protected, for example a zone of an operating station. The operating station may, for example, be a workstation or a storage station. The stream of air prevents the contaminants contained in the surrounding environment from entering the zone to be protected, and in particular protects sensitive products in such zone.

In the description, the word "air" is used to denote any more or less gaseous fluid suitable for the purpose of the invention, for example a gas or a specific gaseous mixture, or an aerosol charged with one or more substances in suspension. This air may be extracted from the atmosphere and possibly treated to make it hygienic vis-a-vis the product to be protected.

The invention may be used in the food processing industry or in the pharmaceuticals industry, and also in catering, the cosmetics industry, electronics or a hospital environment.

DESCRIPTION OF THE RELATED ART

These industries and others require that work be carried out in a fully controlled atmosphere. For example, the atmosphere must be free of dust or microorganisms that might contaminate the product and more generally affect the quality of such product. In this document, the notion of a product covers both objects and human beings, for example patients in a hospital environment.

It is not always possible, technically or financially, to keep a workshop or even a room completely free of contaminants. It may be preferable to ensure only close protection of the products, i.e. to only protect a relatively small zone of the operating station. In addition, this protection must not significantly hinder access to the operating station by production operators.

Devices for the close protection of sensitive products through the diffusion of sterile air are known. For some applications, for example in the pharmaceuticals industry, this stream must be laminar, i.e. characterized by a speed the value and direction of which are uniform in the entire stream, and by a Reynolds number lower than 3,000, which corresponds to flow characteristics beyond which the stream becomes turbulent.

A conventional diffuser comprises a panel diffusing a laminar stream. However, as it moves away from the diffusion panel, the stream drags into its periphery the generally stagnant ambient air, the characteristics of which are different. Thus, the ambient air gradually mixes by induction with the air in the stream, contaminating it and creating perturbations that gradually reduce the laminar section of the stream and therefore the volume that can be protected.

Document FR-A-2.785.040 discloses a diffuser that allows for a decontaminated environment to be created around the air in a stream. This result is obtained by maintaining second, slower, lateral streams around the first stream, i.e. between the first stream and the ambient air.

However, the protective barrier formed in this way is destroyed when it is passed through by an operator, a product or another item, and it takes a considerable time to reform. Moreover, if a very slow first stream is required, even slower second streams will generally be inefficient. Furthermore, the distance beyond which such a device becomes inefficient is relatively short due to the low energy of slow streams, their required divergence and therefore their rapid dilution in the ambient air.

Other devices exist that allow for a fast stream to be created on the periphery of a slow stream, such fast stream acting as a confinement barrier for the slow stream of air. For example, documents FR 2.748.508 and FR 2.788.843 describe porous cylindrical sheaths that diffuse a stream the speed of which increases from the centre outwards. These variations do not allow for a laminar stream to be obtained. Document U.S. Pat. No. 3,776,121 presents stream diffusing plenums that allow for the flow rate, and therefore the air flow speed, to be varied progressively from the centre of the stream outwards. As with the sheaths already mentioned, no laminar stream is obtained. Document WO 91/05210 sets out, in particular in FIG. 3, a diffuser for a slow stream, the speed of which is uniform, and a fast stream, the speed of which is uniform. This fast stream is diffused parallel to and on the periphery of the slow stream. The role of the fast stream is to protect the slow stream from contamination by the ambient air. However, the speed characteristics of the slow stream, which may be laminar, and the fast stream, which is generally turbulent, are significantly different. As it moves away from the diffuser, the fast stream generates more and more perturbations in the slow stream, which gradually reduce the section of the slow stream and therefore the volume that can be protected.

SUMMARY OF THE INVENTION

The purpose of the invention is therefore to propose a method and an associated device for creating a confinement barrier around a zone to be protected bathed by a sustained, barely perturbed principal stream of air that is, for example, substantially laminar, that is, the confinement barrier does not create any turbulence in the principal stream, the principal stream thus being protected, in particular from the risks of contamination and pollution and the risks of perturbation if it is laminar.

According to the invention, such a method for protecting a zone of an operating station consists of establishing an substantially parallel air stream in the direction of such zone with, beyond at least one boundary, a progressively greater speed. It is characterized in that within the aforementioned boundary, the air stream is given a speed that is substantially uniform along a section of the stream in a transverse plane to the direction of flow.

Similarly, according to the invention, a method for protecting a laminar stream, particularly from the risks of contamination, pollution and perturbation, is characterized in that a lateral stream is established with a common boundary with the laminar stream, such lateral stream having a progressively greater speed beyond the boundary, and its speed at the boundary being substantially equal to the speed of the laminar stream.

An air diffuser for the implementation of such a method comprises means of generating at least one principal air stream and on at least one part of the periphery of the principal air stream, a lateral air stream with a flow speed greater than the principal air stream, in such a way as to form an substantially parallel air stream made up at least in part of the principal air stream and the lateral air stream. This diffuser is characterized in that it also comprises means to ensure that the air speed in the principal air stream is substantially uniform along a two-dimensional section of the stream in a transverse plane to the direction of flow.

The means of generation may comprise at least one substantially flat porous principal panel, and at least one porous lateral panel arranged on the periphery of the principal panel, the aforementioned principal panel being designed to diffuse the principal air stream, which is for example laminar, in a principal direction, and the aforementioned lateral panel being arranged to diffuse a lateral air stream that diverges from the principal direction, preferably progressively the further along the lateral panel it is from the principal panel, whilst at the coming out of the lateral panel, the section available for the flow of a given quantity of air in the lateral stream is increasingly small the further away it is from the principal stream, so that the lateral stream is increasingly accelerated the further away it is from the principal stream.

Moreover, the device may comprise a skirt so that the lateral panel is arranged between the principal panel and the skirt, the latter acting as a deflector for at least part of the divergent stream coming from the lateral panel. Preferably, a skirt will be chosen on which an area in contact with a stream is defined by generating lines substantially parallel to the stream or parallel to the principal direction. For example, the skirt may extend in an substantially parallel plane to the principal direction.

Advantageously, at least part of the divergent stream is diffused at a right angle to the principal direction, or even obliquely against the principal stream.

The diffused air, i.e. the air that has just passed through one of the panels, will preferably have an substantially constant speed over the entire diffusion panel. Its speed may however vary progressively the further along the lateral panel it is from the principal panel, for example increasing continuously from the speed of the laminar stream. This may be obtained by varying the pressure losses through the pores in the lateral panel. The slow speed is preferably 0.2 to 0.6 m/s and the fastest speed is between 0.6 and 3 m/s.

The air source may be common to the lateral and principal air streams. For example, the principal and lateral panel may form part of an envelope forming a sheath guiding the air at least to these panels. The air volume defined by the envelope forms the air source and the envelope may comprise other porous or non-porous panels. The pressure of the source upstream of the diffusion panel is advantageously between 0 and 500 Pascals.

The skirt will preferably be arranged in order to form a deflector for the lateral stream so that it forms a deflected stream, for example substantially parallel to the principal direction. At the same time, the skirt will be arranged so that the deflector is not only a guide but also an obstacle to the flow of the stream, and therefore so that the flow section available for the lateral stream decreases as the stream is deflected.

The profile may be progressively curved along the lateral panel away from the principal panel. If the lateral air stream is diffused perpendicular to the lateral panel at all points, its direction varies progressively with the increasing slope of the panel. Thus, the air in the lateral stream is directed towards the deflecting obstacle formed by the skirt, and more particularly towards points of the skirt and at angles that may be different depending on which point of the lateral panel this air was diffused from.

At least part of the diffusion panel may be made of a flexible material, for example a washable or interchangeable fabric, or a single-use fabric, permeable to air. The diffusion panel may also have rigid parts, made of stainless steel for example. It may thus be a perforated metal sheet or metal screen. Generally, it may be made of any porous material that does not generate particles or any other airborne pollution.

The diffuser may be oriented so that the principal stream is directed substantially vertically downwards, for example so that the principal stream bathes a zone to be protected on an operating station.

The skirt chosen is of the correct length to keep the streams as coherent as possible up to the zone to be protected without hindering the access of the operators and/or the products processed in the zone. For example, for a diffuser on which two opposite edges each comprise a lateral panel arranged respectively between a skirt and a principal panel, beyond the principal panel each skirt will have a length substantially equal to half of the distance between the two skirts. One skirt will preferably have a length substantially equal to or greater than three times the thickness of the fast stream, i.e. three times the shortest distance between the skirt and the principal panel. Beyond each skirt, the respectively deflected streams will maintain their coherence over a length substantially equal to the distance between the two skirts. These deflected streams will be unaffected by being passed through, for example by the operators and/or the products processed, and will regain their coherence as soon as they have been passed through.

The air used may be extracted from the atmosphere and then, for example, treated to sterilise it. Particularly if the air diffused is not used for breathing, air comprising a gas or a specific gaseous mixture may also be used, for example that is neutral vis-a-vis the products processed, i.e. does not interact with the products. Thus, it may desirable that the air does not contain any element that might oxidise these products.

According to the invention, an air diffuser may be combined with either a production line, a machine tool, a bed, an operating table or a display cabinet. Thus, the diffuser and the equipment with which it is combined are fitted to each other to provide optimum protection.

BRIEF DESCRIPTION OF THE DRAWINGS

The following description gives other features and advantages of the invention, relating to non-limitative examples.

On the appended drawings.

DESCRIPTION OF THE PREFERRED EMBODIMENTS

Figure 1:
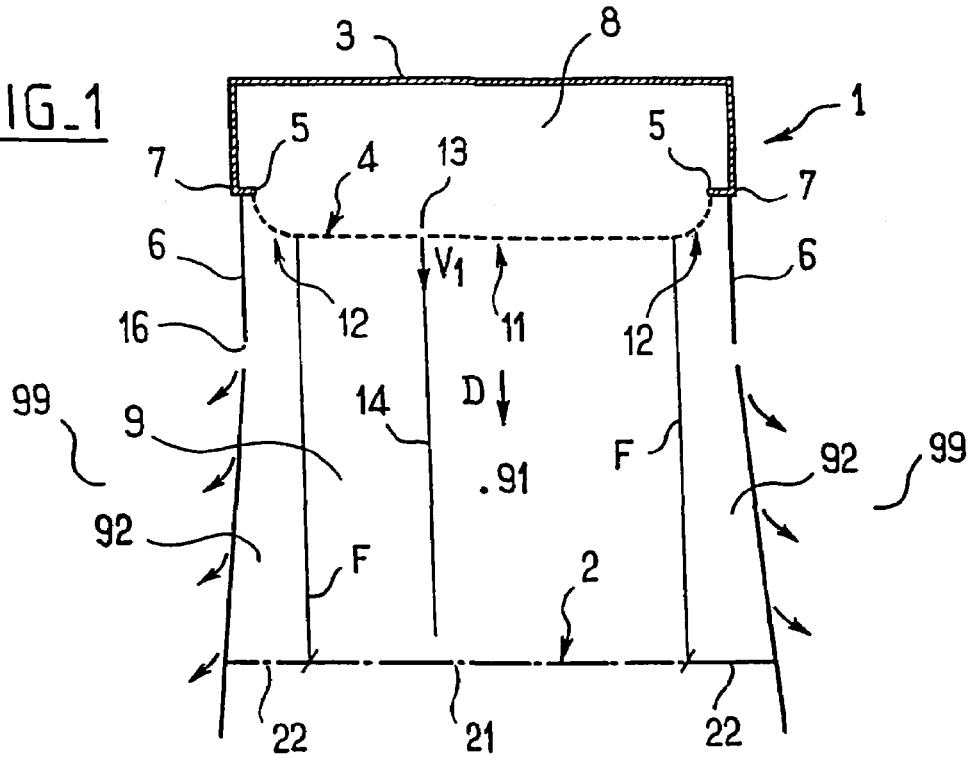
FIG. 1 is a schematic representation of a transverse vertical cross-section of a diffuser according to the invention used as a blowing ceiling.

FIG. 1 represents a diffuser 1 used as a ceiling blower, that is, it is arranged above a zone 2 to be protected, which may correspond to part or all of an operating station. It diffuses an appropriate gas, such as dust-free air 9, vertically downwards onto the zone 2. The diffuser 1 comprises a metal housing 3, which opens downwards between parallel, opposite lips 5. A diffusion panel 4 extends between the two lips 5 across the whole opening defined between the lips 5. Skirts 6 are arranged along opposite edges 7 of the housing 3, parallel to the lips 5, so that the diffusion panel 4 is between the skirts 6, which are directed downwards from the lower side of the housing 3.

The housing 3 and the diffusion panel 4 define an inner volume 8 that is regularly supplied with treated pressurised air and acts as an air source for the diffuser. A supply, not shown, is arranged upstream of the inner volume 8. It generally comprises a prefilter for air drawn from the atmosphere, then a fan and finally a very high efficiency filter to ensure that the air is suitably dust-free.

The diffusion panel, which here is a perforated metal sheet, may be split into three panels, an substantially flat horizontal principal panel 11 and two lateral panels 12 that are quarter cylinders each with an axis parallel to the lips 5. Each lateral panel is arranged between one of the lips 5 on the housing and the principal panel, forming a curved extension of the principal panel 11. The axes of the cylinders are in the inner volume 8, so that the lateral panels are convex on the outer side of the housing 3.

Each perforation in the diffusion panel 4 is a pore through which the air can be diffused from the inner volume 8 through the diffusion panel 4. The porosity is the same over the entire diffusion panel, i.e. the pores are evenly distributed and are of substantially the same shape and size. They are sufficiently small and close together for each jet of air 14 coming out of any of the pores 13 forms a coherent whole with jets of air coming out of neighbouring pores. In the example in FIGS. 1 and 2, the diffusion panel is fine and the pores do not have a directional role, i.e. they are not, for example, shaped like a nozzle that would impose a direction on the diffused air. Thus, the air is diffused substantially perpendicular to the diffusion panel 4 at each pore. Similarly, the inner volume 8 forms a single source with substantially uniform pressure and the diffusion speed V1 of all of the air jets is substantially the same.

The air 9 coming from the diffuser 1 comprises a principal air stream 91 from the principal panel 11, and lateral air streams 92, from each of the lateral panels 12. The principal panel 11 forms a horizontal plane, so that the principal diffusion speeds V11 in the air stream 91 when it is diffused by the panel 11 are uniform in value and direction in a principal direction D, directed vertically downwards. The principal diffusion speeds V11 are kept below a threshold value, for example 0.6 m/s, beyond which an air stream is no longer laminar. The principal stream diffused is laminar.

The principal stream 91, coming from the principal panel 11, maintains a uniform speed. That is, its principal flow speed V21 (FIG. 2) when it crosses through a plane P corresponding to the lower edge 16 of the skirt 6, is substantially the same in direction and value as the principal diffusion speed V11.

The lateral diffusion speeds V12 in a lateral air stream 92 when it is diffused by the panel 12 are uniform in value and equal to the principal diffusion speeds V11. However, the orientation of the speed of each lateral air jet depends on the position of the pore that the jet comes from. Thus, the directions of the lateral diffusion speeds V12 diverge progressively from the principal direction D the further along the lateral panel 12 from the principal panel 11 they are. Consequently, the direction of a lateral diffusion speed V12 of an air jet from a pore close to the principal panel is substantially the same as the principal direction D, and therefore substantially parallel to the skirts 6. However, the direction of a lateral diffusion speed V12 of an air jet from a pore close to a lip 5 is substantially perpendicular to the principal direction D and therefore directed horizontally towards the closest skirt 6, substantially perpendicular to the plane of that skirt.

Figure 2:
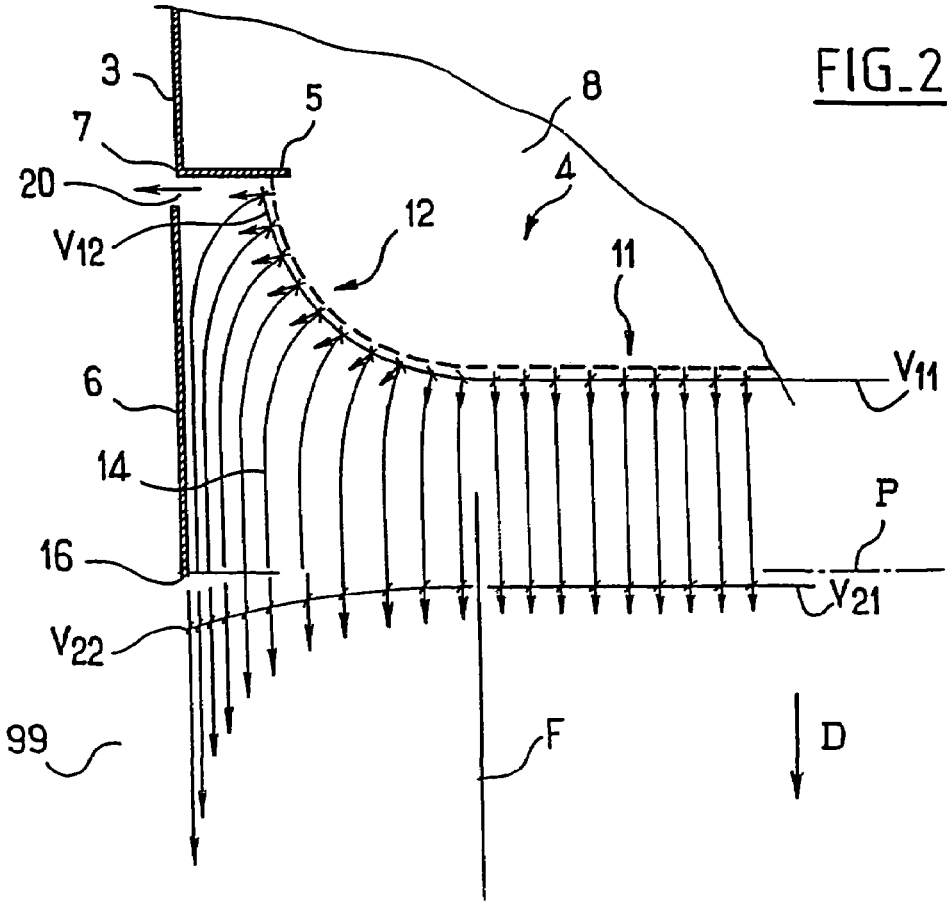
FIG. 2 is a detailed view of FIG. 1, near a lateral panel, illustrating air streams coming from the diffuser.

Thus, in reference to the detail in FIG. 2, the skirt 6 is an obstacle to the flow of the air jets 14 diffused through the lateral panel 12. The air jets diffused in this way will be concentrated against the skirt 6, which deflects them, and will then move along it to its lower edge 16. The closer the pore through which an air jet comes is to the lip 5, the smaller the section available for the flow of the jet. For a constant flow rate of the air jet, this leads to an increase in its flow speed.

As a result, in a horizontal plane P (see FIG. 2) corresponding to the lower edge 16 of the skirt 6, the lateral flow speeds V22 of the deflected lateral stream have substantially the same direction as each other, parallel to the principal direction D, but have values that start from a minimum value equal to the speed V21 of the principal stream along the boundary F and increase the further along the plane P they are towards the lower edge 16 of the skirt 6.

Thus, along the boundary F, the lateral stream has the same speed as the principal stream and then its speed increases, slowly at first and then more and more quickly the further away it is from the boundary F. Thus, the boundary F is an substantially vertical plane that remains beyond the plane P, just like the laminar character of the principal stream.

Opposite and beyond the plane P, the lateral stream tends to recover space for its flow by reducing the space occupied by the ambient air 99. Thus, the lateral stream tends to expand by pushing back the ambient air, which contributes to increasing the protected zone 2 by forming a confinement barrier for the laminar stream. In reference to FIG. 1, this protected zone can be divided into three parts. Between the boundaries F is a part 21 bathed by the slow laminar principal stream 91, and beyond the boundaries F are two lateral parts 22 bathed by a lateral stream, which becomes faster and more turbulent the further away it is from the boundaries. The skirts are sufficiently short to provide a clear opening under their lower edge 16 and above the zone 2. Beyond the skirt, the outer jets of the lateral stream, which are initially the fastest, may then slow down by dragging in ambient air and expanding into it, but the jets located within the skirt prevent too much slowing and, in any event, maintain the protection of the principal stream.

An opening has been made between the lip 5 of the housing 3 and the skirt 6 to create a leakage 20 of part of the lateral stream. This prevents the creation of excessive turbulence in a zone delimited by the housing, between the edge 7 and the lip 5, and the top of the skirt. Moreover, if the skirt 6 is designed to be removable, it is difficult to ensure an airtight seal between the skirt 6 and the housing 3. A pump effect through a poor seal would result in the pollution of the diffused air by ambient air 99. Thus, the excess pressure between the lateral panel and the skirt generates the leakage 20 and prevents this pump effect without requiring an airtight seal between the skirt 6 and the housing 3.

It may be necessary to provide lighting for the protected zone. If such lighting is arranged in the protected zone the flow of the stream in the zone will be perturbed. It is therefore advantageous to provide lighting upstream of the diffusion panel, for example in the inner volume 8. The diffusion panel is then adapted to allow the light to pass through the panel into the operating zone. Thus, the porosity may be sufficient for the light to pass through and/or the panel may be made of a transparent or translucent material. The lighting means may also be arranged in the panel.

As far as possible, it is also preferable to diffuse air that has already been treated so that it is no longer necessary to have air treatment devices in the protected zone that might perturb the air flow. These treatment devices may comprise air conditioning equipment for the air hygrometry or temperature, means of mixing gases into the air or means of charging the air with particles, thus forming an aerosol. These particles may be liquid or solid, such as a powder. These particles may be a disinfectant substance that keeps the diffusion panel free from contamination. The means of charging the air may be nozzles arranged upstream of the diffusion panel. Other means such as pulsed light or ultraviolet lights may be installed upstream of the diffusion panel to decontaminate the air and surfaces such as the surface of the housing or panel.

Figure 3:
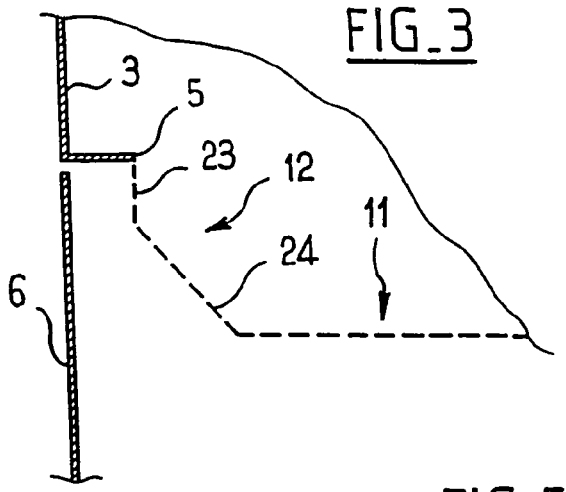
FIGS. 3 to 5 are detailed views illustrating possible geometric configurations for a lateral panel.
Figure 4:
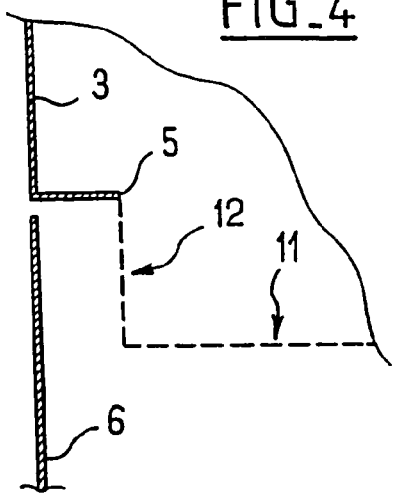
Figure 5:
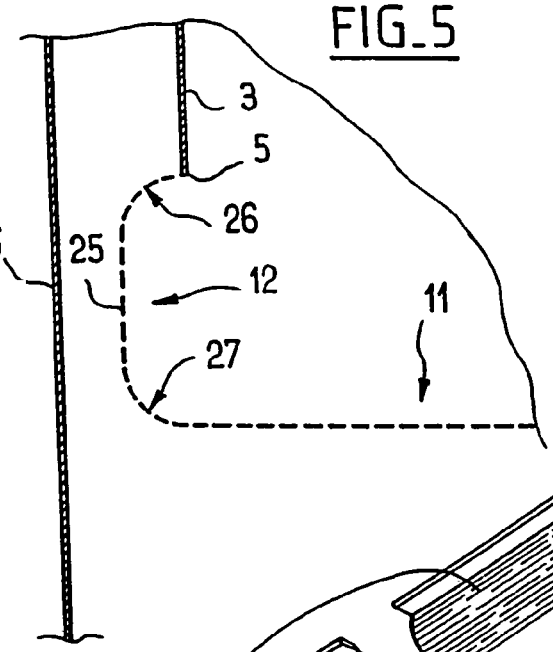

Configurations other than a quarter cylinder are possible for a lateral panel 12. In FIG. 3, it is made up of a flat part 23 extending parallel to direction D from the lip 5 and connected to the principal panel 11 by another flat part 24 inclined at 45 degrees relative to the principal panel. In FIG. 4, the lateral panel 12 forms a right angle with the principal panel and follows a straight profile to the lip 5. In the configuration in FIG. 5, the principal panel extends until it is level with the lip 5 and is then connected by a lateral panel made up of two quarter cylinders, 26, 27 flanking a flat part 25 perpendicular to the principal panel. The skirt is offset laterally to the outside relative to the housing and comes up higher than the lip 5. The edge 7 of the housing merges with the lip 5.

Figure 6:
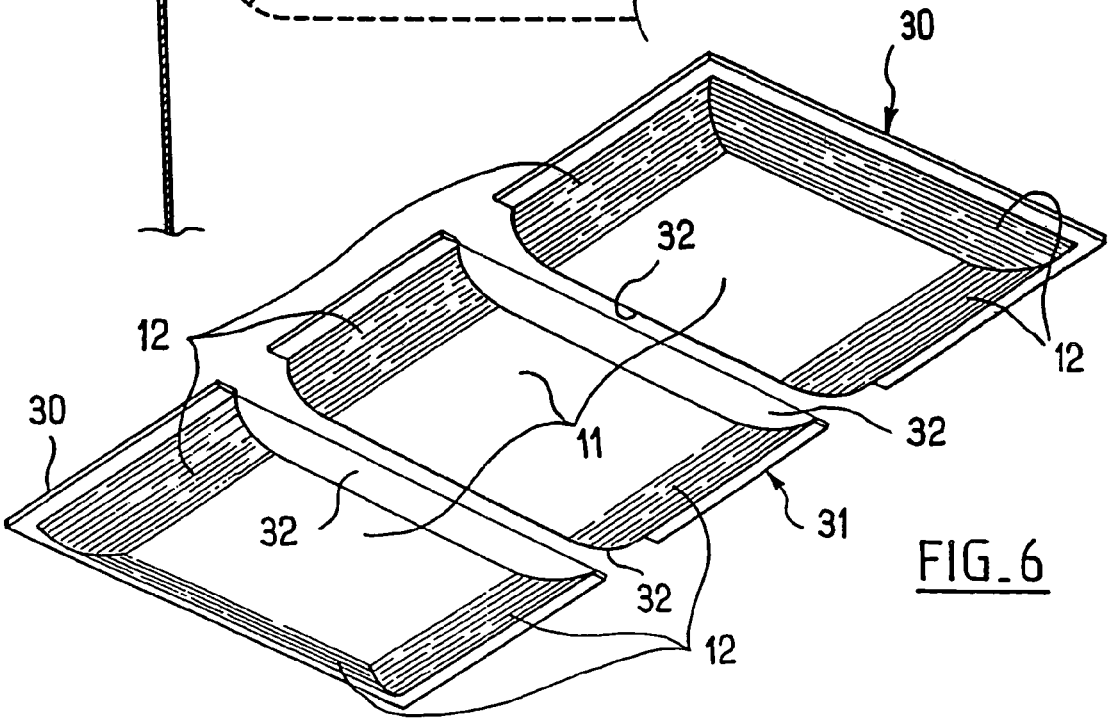
FIG. 6 is a perspective representation of a modular diffusion panel for a diffuser according to the invention.

Instead of being all in one piece, the diffusion panel may be modular, which allows for large areas or areas with a complex shape to be covered, or for several sources to be used, simultaneously or otherwise. FIG. 6 shows a diffusion panel made up of three modules, normally abutting but shown separated for the clarity of the description. It comprises two end modules 30 and one intermediate module 31, all built on a rectangular base. The end module comprises on two opposite sides of a principal panel 11, lateral panels 12, and on its two other opposite sides, a partition 32. The two end modules comprise on three of their sides a lateral panel 12 and on the fourth side a partition 32 to coincide with a partition 32 on the intermediate module 31 when they are assembled. The partitions 32 extend perpendicular to the base of each of the modules. Their main role is to ensure that each module is rigid, and to contribute to forming an airtight seal between two contiguous modules.

Thus, as required, a diffusion panel can be built with several intermediate modules or, conversely, a panel can be built with only two end modules assembled contiguously. If contiguous modules are connected to different sources, they can be used to diffuse differently treated air without interrupting the continuity of the laminar stream. Thus, for example, a first module may diffuse air that has simply been filtered and have a light source, a second module may be used to diffuse air charged with water particles in the form of a mist and a third module may diffuse dry, warm air.

Of course, the invention is not limited to the examples given above, and numerous adjustments can be made to these examples without exceeding the scope of the invention.

Thus, the skirts may be rigid or flexible, transparent or not and long or short. Moreover, panels close to the diffuser may act as skirts, whether they are horizontal or vertical, flat or otherwise, rough or smooth and fully or only partly airtight, as long as they form an effective deflector for the divergent lateral stream and do not introduce excessive turbulence. The housing is not necessarily a parallelepiped but may be the end of a sheath or even the side of a sheath equipped with an opening and lips for a diffusion panel to be fitted. The invention may also be designed so that the principal direction is not vertical. This direction may be horizontal for a wall diffuser.

A zone to be protected may or may not be mobile and may be a few centimetres in size or comprise a conveyor several metres long. It is not necessarily a plane surface but may also be a volume. A diffuser according to the invention may be adapted to protect a zone whatever its dimensions.

Depending on the protection required, the lateral stream does not necessarily surround the entire principal stream. It may be split up and other faster or slower streams may occupy part of the periphery of the principal stream or exist beyond the lateral stream.

The operating station may be limited to one machine or part of a machine. The station may not be designed for an operator to penetrate the stream during normal operation of the machine.

Further, the invention is not limited to the pharmaceuticals industry and can also be used in any type of industry sensitive to airborne contamination, such as the food processing industry, the cosmetics industry, the electronics industry, healthcare and any other type of laboratory. It may be installed in a room in which dust or another type of contamination is already under control.

The invention can also be applied in distribution, such as the distribution of food and in particular in catering. Thus, the invention may comprise a display cabinet for food products provided for customers, for example on a buffet, or be used to display refrigerated products in a shop, such as a butcher's or a cake shop.

In the field of healthcare, the invention may have a number of applications. In a dentist's surgery, it may for example be adapted to diffuse a hygienic stream over a jaw undergoing treatment. An emergency vehicle may be equipped with the invention to protect casualties from bacterial contamination during transport. An operating theatre or recovery room may also comprise the invention for sanitary purposes to diffuse a hygienic stream over all or part of a patient's body. Thus, the invention may comprise a bed. Particularly in the case of a third-degree burns victim, the invention may comprise means of diffusing very moist air over the wound, possibly containing painkilling or and/or disinfectant substances. Air charged with a disinfectant substance, diffused by the invention, is particularly appropriate for preventing nosocomial infections.

The operating station may be fitted with means of absorbing the stream so that the stream is not or is only slightly perturbed near, for example, a table or a conveyor designed to support the sensitive product. Thus, a support of this type may be porous and fitted with an air extractor. Means of absorption will also be useful if the air diffused should not be mixed with the surrounding environment, particularly if the air diffused is toxic.

Furthermore, a diffuser according to the prior art may be converted into a diffuser according to the invention, by replacing a prior diffusion panel by a principal panel and a lateral panel according to the invention of the appropriate size and by adding as many skirts as necessary. Another possibility is to add a diffuser according to the invention to a pre-existing diffuser, thus creating a mixing space between a diffusion panel for the pre-existing diffuser and the panels of the diffuser according to the invention. This mixing space allows for the static and dynamic characteristics of the air, particularly the pressure, to be homogenised before the air is diffused. The thickness of this space may advantageously be equal to the height of the lateral panels.

The invention claimed is:

1. Method for protecting a zone of an operating station comprising the step of:

directing, toward said a zone of an operating station, a substantially parallel air flow comprising an inner air stream within a boundary and an outer lateral air stream beyond said boundary, wherein, the inner air stream is diffused through a substantially flat porous material, the inner air stream is given a speed which is substantially uniform as measured in a plane transverse to air flow direction, and said outer lateral air stream is given a speed which progressively increases as a distance from said boundary increases so as to create the outer lateral air stream with sufficient pressure to prevent divergence of the inner air stream without creating noticeable flow perturbation in the inner air stream.

2. Method for protecting a zone of an operating station comprising:

emitting an air flow through a diffusion panel at a speed substantially uniform in value; and providing means to progressively reduce the section available for flow of a lateral stream part of the air flow, lateral relative with a principal stream part of said air flow, so that said lateral stream is subjected to a progressively greater acceleration as more distant from the principal stream.

3. Air diffuser for protecting a zone of an operating station, comprising:

means for generating (i) a principal air stream through a substantially flat porous principal panel part of a diffusing panel; and, (ii) on at least part of the periphery of the principal stream, a lateral air stream through a lateral panel which is part of the diffusing panel;

means to make a diffusion speed of the principal air stream substantially uniform in value and direction; and, means to make the lateral stream substantially parallel to the principal stream, and to make a speed in the lateral air stream equal and parallel to the diffusion speed, in the immediate vicinity of the principal air stream, and progressively greater as more distant from the principal stream.

4. Air diffuser according to claim 3, wherein the speed in the lateral air stream increases, very slowly at first and then more and more quickly the further away it is from the principal stream.

5. Air diffuser according to claim 3, wherein in a transverse plane, the air speed measured in the lateral stream diverges progressively from the direction of the principal stream the further away it is from said principal stream.

6. Air diffuser according to claim 3, wherein the generation means comprise a porous lateral panel arranged on the periphery of the principal panel, the pressure losses through the pores in the lateral panel varying so that the air speed through the lateral panel increases continuously from the speed of the principal stream, the further away the lateral stream is from the principal panel.

7. Air diffuser according to claim 3, wherein the diffusion panel has a substantially constant porosity.

8. Air diffuser according to claim 3, wherein the generation means comprise at least the substantially flat porous principal panel and at least one porous lateral panel arranged on the periphery of the principal panel, the aforementioned principal panel being designed to diffuse the principal air stream in a principal direction and the aforementioned lateral panel being arranged to diffuse a lateral air stream divergent from the principal direction, and that at the end of the lateral panel, the section available for the flow of a given quantity of air in the lateral stream is increasingly small the further away it is from the principal stream, so that the lateral stream is increasingly accelerated the further away it is from the aforementioned principal stream.

9. Air diffuser according to claim 8, wherein a skirt is arranged in such a way that the lateral panel is located between this skirt and the principal panel and the aforementioned skirt being arranged to deflect at least part of the divergent stream coming from the lateral panel.

10. Air diffuser according to claim 9, wherein the flow speed of the principal stream when it passes through a plane corresponding to the lower edge of the skirt is substantially identical in direction and value to the principal diffusion speed.

11. Air diffuser according to claim 9, wherein in an area of the skirt in contact with a stream is defined by generating lines substantially parallel to the stream or parallel to the principal direction.

12. Air diffuser according to claim 9, wherein beyond the principal panel, the length of the skirt is substantially equal to or greater than three times the thickness of the fast stream, and is three times the shortest distance between the skirt and the principal panel, and, when two opposite edges of the aforementioned diffuser each comprise a lateral panel respectively arranged between a skirt and a principal panel, the length of each skirt beyond the principal panel is substantially equal to half of the distance between the two skirts.

13. Air diffuser according to claim 9, wherein the principal and lateral panels are panels of a housing, the skirt being arranged so that an opening is formed between the housing and the skirt to create a leakage of part of the lateral stream.

14. Air diffuser according to claim 3, wherein the lateral panel is arranged so that the lateral air stream diverges progressively from the principal direction the further along the lateral panel it is from the principal panel.

15. Air diffuser according to claim 3, wherein the principal air stream is substantially laminar.

16. Air diffuser according to claim 3, wherein the air is diffused at a substantially constant speed through the entire diffusion panel.

17. Air diffuser according to claim 3, wherein the air is diffused from a single-volume of air, an envelope of which comprises the diffusion panel.

18. Air diffuser according to claim 3, wherein the diffusion panel has a profile that curves progressively along the lateral panel away from the principal panel.

19. Air diffuser according to claim 3, wherein at all points of the diffusion panel a plane tangent to the aforementioned panel is perpendicular to the direction of the air stream.

20. Air diffuser according to claim 3, wherein the diffusion panel comprises an air permeable fabric.

21. Air diffuser according to claim 3, which is arranged so that the principal stream bathes a zone to be protected on an operating station.

22. Air diffuser according to claim 21, wherein unrestricted access to the operating station and/or the zone to be protected is allowed.

23. Air diffuser according to claim 3, further comprising means of lighting the protected zone located at one of upstream of the diffusion panel and in the diffusion panel.

24. Air diffuser according to claim 3, which comprises, upstream of the diffusion panel, means to charge the air with particles; these particles may form an aerosol and be solid or liquid.

25. Air diffuser according to claim 3, which is made up of several modules.

26. Air diffuser according to claim 25, wherein at least two of the modules are connected to different air sources.

27. Combination of an air diffuser according to claim 3, with either a production line, a machine tool, a bed, an operating table or a display cabinet.

28. Air diffuser for protecting a zone of an operating station, comprising:

generating means for generating an air flow, substantially parallel to a direction of flow, said air flow comprising a principal air stream, and, on at least part of the periphery of the principal air stream, a lateral air stream, which generating means comprise means for generating the principal air stream through a substantially flat porous principal panel, which is part of a diffusing panel, so that a flow speed in said principal air stream is substantially uniform in speed and value along a two dimensional section of the stream in a plane transverse to the direction of flow; and means for generating the lateral air stream through a lateral panel which is part of the diffusing panel, the lateral air stream being contiguous to the principal air stream along a boundary, at a flow speed greater than the flow speed in the principal air stream, the speed of the air in the lateral stream at the boundary being substantially equal to the uniform speed in the principal stream, and progressively increasing the further away it is from said boundary.

29. Air diffuser according to claim 28, wherein along the boundary, the lateral stream has the same speed as the principal stream and then its speed increases, very slowly at first and then more and more quickly the further away it is from the boundary.

30. Air diffuser according to claim 28, the lateral stream of which is contiguous to the principal stream along the boundary, wherein, in the transverse plane, the air speed measured in the lateral stream diverges progressively from the direction of the principal stream the further away it is from the aforementioned boundary.

31. Air diffuser according to claim 28, wherein the generation means comprise a porous lateral panel arranged on the periphery of the principal panel, the pressure losses through the pores in the lateral panel varying so that the air speed through the lateral panel increases continuously from the speed of the principal stream, the further away the lateral stream is from the principal panel.

32. Air diffuser according to claim 28, wherein the diffusion panel has a substantially constant porosity.

33. Air diffuser according to claim 28, wherein the generation means comprise at least the substantially flat porous principal panel and at least one porous lateral panel arranged on the periphery of the principal panel, the aforementioned principal panel being designed to diffuse the principal air stream in a principal direction and the aforementioned lateral panel being arranged to diffuse a lateral air stream divergent from the principal direction, and that at the end of the lateral panel, the section available for the flow of a given quantity of air in the lateral stream is increasingly small the further away it is from the principal stream, so that the lateral stream is increasingly accelerated the further away it is from the aforementioned principal stream.

34. Air diffuser according to claim 33, wherein a skirt is arranged in such a way that the lateral panel is located between this skirt and the principal panel and the aforementioned skirt being arranged to deflect at least part of the divergent stream coming from the lateral panel.

35. Air diffuser according to claim 34, wherein the flow speed of the principal stream when it passes through a plane corresponding to the lower edge of the skirt is substantially identical in direction and value to the principal diffusion speed.

36. Air diffuser according to claim 34, wherein in an area of the skirt in contact with a stream is defined by generating lines substantially parallel to the stream or parallel to the principal direction.

37. Air diffuser according to claim 34, wherein beyond the principal panel, the length of the skirt is substantially equal to or greater than three times the thickness of the fast stream, three times the shortest distance between the skirt and the principal panel, and, when two opposite edges of the aforementioned diffuser each comprise a lateral panel respectively arranged between a skirt and a principal panel, the length of each skirt beyond the principal panel is substantially equal to half of the distance between the two skirts.

38. Air diffuser according to claim 34, wherein the principal and lateral panels are panels of a housing, the skirt being arranged so that an opening is formed between the housing and the skirt to create a leakage of part of the lateral stream.

39. Air diffuser according to claim 28, wherein the lateral panel is arranged so that the lateral air stream diverges progressively from the principal direction the further along the lateral panel it is from the principal panel.

40. Air diffuser according to claim 28, wherein the principal air stream is substantially laminar.

41. Air diffuser according to claim 28, wherein the air is diffused at a substantially constant speed through the entire diffusion panel.

42. Air diffuser according to claim 28, wherein the air is diffused from a single-volume of air, an envelope of which comprises the diffusion panel.

43. Air diffuser according to claim 28, wherein the diffusion panel has a profile that curves progressively along the lateral panel away from the principal panel.

44. Air diffuser according to claim 28, wherein at all points of the diffusion panel a plane tangent to the aforementioned panel is perpendicular to the direction of the air stream.

45. Air diffuser according to claim 28, wherein the diffusion panel comprises an air permeable fabric.

46. Air diffuser according to claim 28, which is arranged so that the principal stream bathes a zone to be protected on an operating station.

47. Air diffuser according to claim 46, wherein unrestricted access to the operating station and/or the zone to be protected is allowed.

48. Air diffuser according to claim 28, further comprising means of lighting the protected zone located at one of upstream of the diffusion panel and in the diffusion panel.

49. Air diffuser according to claim 28, which comprises, upstream of the diffusion panel, means to charge the air with particles; these particles may form an aerosol and be solid or liquid.

50. Air diffuser according to claim 28, which is made up of several modules.

51. Air diffuser according to claim 50, wherein at least two of the modules are connected to different air sources.

52. Combination of an air diffuser according to claim 28, with either a production line, a machine tool, a bed, an operating table or a display cabinet.

53. Air diffuser, comprising:

a new diffusion panel to replace or superimpose an existing diffusion panel, the new diffusion panel comprising at least one substantially flat porous principal panel and at least one porous lateral panel arranged on the periphery of the principal panel, the aforementioned principal panel being designed to diffuse a principal air stream in a principal direction and the aforementioned lateral panel being arranged to diffuse a lateral air stream divergent from the principal direction, and in that at the end of the lateral panel, the section available for the flow of a given quantity of air in the lateral stream is increasingly small the further away it is from the principal stream, so that the lateral stream is increasingly accelerated the further away it is from the aforementioned principal stream.

* * * * *